US005216195A

United States Patent [19]

Tuma

[11] Patent Number: 5,216,195

[45] Date of Patent: Jun. 1, 1993

[54] FIREARM

[75] Inventor: Martin Tuma, Solothurn, Switzerland

[73] Assignee: ITM Industrial Technology & Machines AG, Solothurn, Switzerland

[21] Appl. No.: 813,810

[22] Filed: Dec. 26, 1991

[30] Foreign Application Priority Data

Nov. 8, 1991 [EP] European Pat. Off. ..... 91119071

[51] Int. Cl.[5] ..... F41A 19/51

[52] U.S. Cl. ..... 89/147; 42/69.03; 89/145; 89/146

[58] Field of Search ..... 42/69.03; 89/147

[56] References Cited

U.S. PATENT DOCUMENTS

| | | | |
|---|---|---|---|
| 2,138,213 | 11/1938 | Seidel | 89/147 |
| 4,589,326 | 5/1986 | Kuckens et al. | 89/147 |
| 4,589,327 | 5/1986 | Smith | 89/147 |

FOREIGN PATENT DOCUMENTS

| | | | |
|---|---|---|---|
| 604176 | 10/1934 | Fed. Rep. of Germany | 42/69.03 |
| 612895 | 5/1935 | Fed. Rep. of Germany | 42/69.03 |

*Primary Examiner*—Stephen C. Bentley

*Attorney, Agent, or Firm*—Ladas & Parry

[57] ABSTRACT

The sear is rotatably supported in the frame of the firearm to rotate around an axis of rotation. The hammer is pivotally mounted in the frame to pivot around a pivot axis. The hammer includes a striking surface. The sear includes a blocking surface which cooperates with a resting surface of the hammer. The position of the blocking surface of the sear which is determined by its axis of rotation, the position of the striking surface of the hammer, which is determined by the location of the pivot axis of the hammer, and the position of the rear end of the firing pin are selected in such a manner that when the hammer is in its decocked position, in which position the resting surface contacts the blocking surface, the striking surface of the hammer is at a distance from the rear end of the firing pin. Accordingly, the hammer does not contact in its decocked state the firing pin such that eg upon a dropping of the firearm a shot may inadvertently be fired. Furthermore, because the hammer is in its decocked position already remote from the rear end of the firing pin, a shorter and smoother path of pulling the trigger is needed when firing the firearm, which allows an improved hitting of a target. The hammer is automatically decocked after each shot.

2 Claims, 6 Drawing Sheets

FIREARM

BACKGROUND OF THE INVENTION

1. Field of the Invention

The present invention relates to a firearm, including a frame; a slide mounted on the frame for a sliding longitudinal movement thereupon; a trigger pivotally mounted to the frame for movement between a rest position and a firing position; a trigger bar pivotally mounted to the trigger for moving therewith between a rest position and a firing position; a firing pin having a front and a rear end and mounted in the slide for travel between a rest position and a firing position; a hammer pivotally mounted to the frame for a pivoting movement around a pivot axis between a decocked and a cocked position, which hammer includes a striking surface adapted to strike onto the rear end of the firing pin, and includes further a resting surface; a spring loaded sear rotatably mounted to the frame for a rotational movement around an axis of rotation between a hammer blocking position and a hammer release position, which sear includes a hammer blocking surface adapted to contact the resting surface of the hammer when the hammer is in its decocked position, which hammer blocking surface is at a rotational position remote form the resting surface of the hammer when the sear is in its hammer release position.

2. Description of the Prior Art

In its decocked state the hammer of known designs of firearms, such as pistols, is located in a position in which is continuously contacts the rear end of the firing pin. This state gives rise to the danger that when the firearm is accidentally dropped or when it is manipulated in an unlucky manner, or when the hammer gets caught at an obstacle (piece of clothing), a live round chambered in the pistol can be inadvertently fired, and, furthermore, when the weapon is to be fired, the trigger must be pulled along a considerable distance at a corresponding exertion of force such that the pulling of the trigger renders a precise firing or hitting a target, respectively, more difficult.

Furthermore, the hammer of further known firearms, such as semi-automatic pistols, remains after the loading, ie chambering of a cartridge or also after a firing of a shot in its cocked position such that it is quite easy to fire rather inadvertently a second shot which for instance may occur in a stress position.

SUMMARY OF THE INVENTION

Hence, it is a general object of the present invention to provide a firing arm in which the hammer is arrested in its decocked state in such a position in which its striking surface is kept at a distance from the rear end of the firing pin and in which a cocking of the hammer for firing a shot proceeds at a reduced necessity of application of a force and at a shorter distance of movement of the trigger.

A further object is to provide a firearm in which the location of the blocking surface of the sear, relative to its axis of rotation, the location of the arresting surface of the hammer relative to its pivot axis and the location of the rear end of the firing pin in its rest position are selected in such a manner that when the hammer is in its decocked position the blocking surface of the sear contacts the arresting surface of the hammer and the striking surface of the hammer is located at a distance from the rear end of the firing pin.

The advantages gained by the invention are substantially a prevention of the hammer, when the firearm is inadvertently dropped or also when a wrong manipulation at the firearm is made, from striking onto the firing pin, thus releasing a shot, such that the safety of the firearm is considerably increased.

Due to the fact that for firing a shot the hammer and accordingly the trigger must be pulled along a shorter distance, a smaller exertion of force for firing a shot is needed, wherewith an aiming and a hitting of a given target can proceed at increased precision.

Furthermore, the hammer decockes after each firearm loading movement of the slide, may such be upon a manual loading or upon a firing of a single shot, such that it is not possible to fire a second shot without any further ado. After each loading movement, and thus also after each firing of the gun, the hammer moves into its decocked position, in which position it additionally does not contact or rest, respectively, against the firing pin. Due to this situation the projection at the hammer to allow a manual decocking is no longer necessary. It is generally known that due to a possible catching of this projection of the hammer at a piece of clothing, there always exists a certain danger when manipulating firearms.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
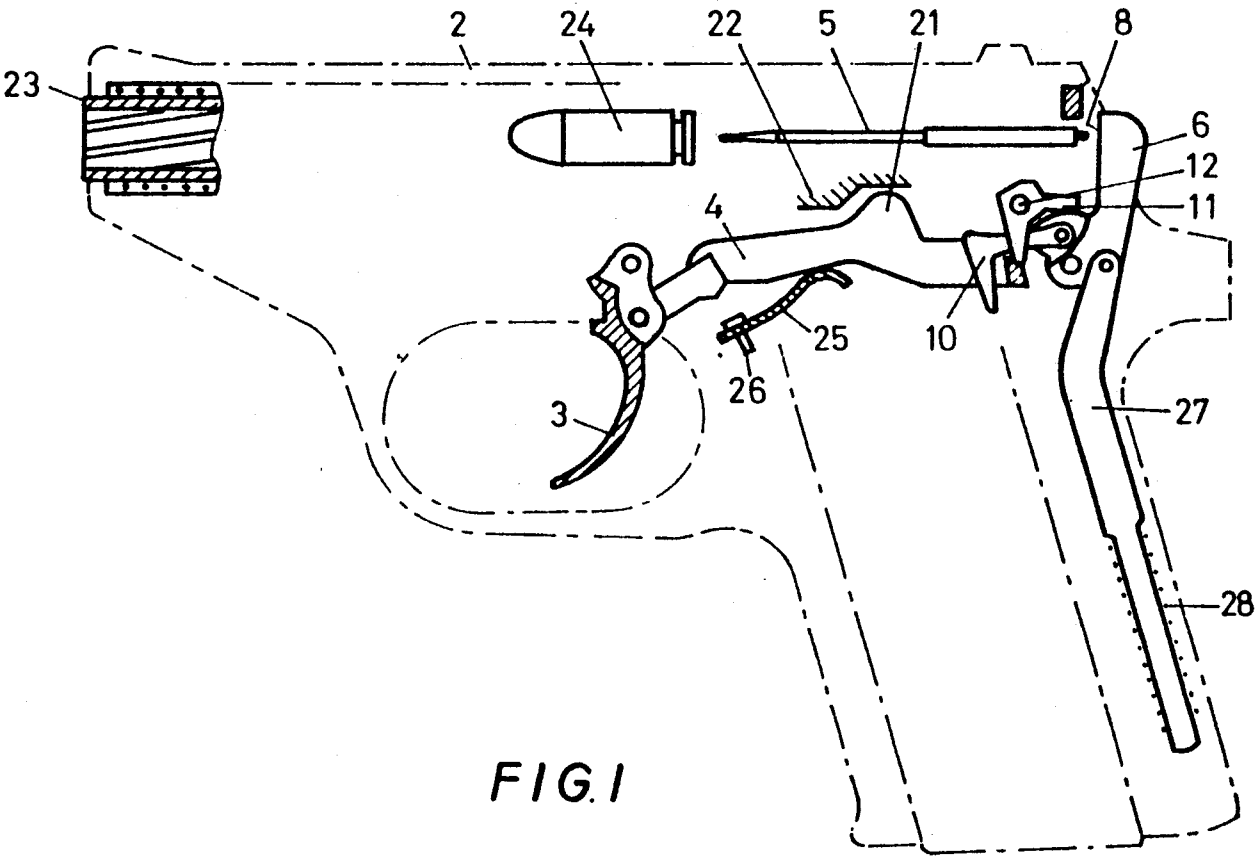
FIG. 1 illustrates somewhat simplified and schematically a pistol for a general disclosure of an embodiment of the invention, whereby the frame of the pistol is illustrated by broken lines.

FIG. 1 illustrates on a simplified basis a pistol in which the present invention is embodied. It shall be noted, basically, that the illustrated pistol is of the design which operates only in the double action mode. A slide 2 is mounted upon the frame 1, which is designed merely by broken lines for a sliding, reciprocating movement thereover. Furthermore, a part of the barrel 23 and a chambered cartridge 24 are visible. The pistol includes a trigger 3, which is pivotally mounted to the frame 1. A trigger bar 4 is pivotally mounted to the trigger 3. This trigger bar 4 is visible in a top view in FIG. 6. A leaf spring 25 is mounted by means of a threaded bolt 26 to the frame 1. This leaf spring 25 biases the trigger bar 4 in the illustration according to FIG. 1 upwards. A firing pin 5 is supported in the slide 2 for a reciprocating movement. The hammer 6 includes a striking surface 8 adapted to strike onto the rear end of the firing pin 5. As can be clearly seen in the figures, the hammer has no so-called decocking projection for a manual decocking thereof. A hammer rod 27 is pivotally mounted to the hammer 6, which hammer rod 27 rests against the hammer spring 28. FIG. 1 illustrates, furthermore, the interrupter 10, the sear 11 and the pivot axis 12 of the sear 11. Further visible in FIG. 1 is that the trigger bar 4 includes a cam-shaped projection 21.

This projection 21 is adapted &o cooperate with a control incline 22 formed at a bottom area of the slide 2, and the operation thereof will be explained more in detail further below.

Figure 2:
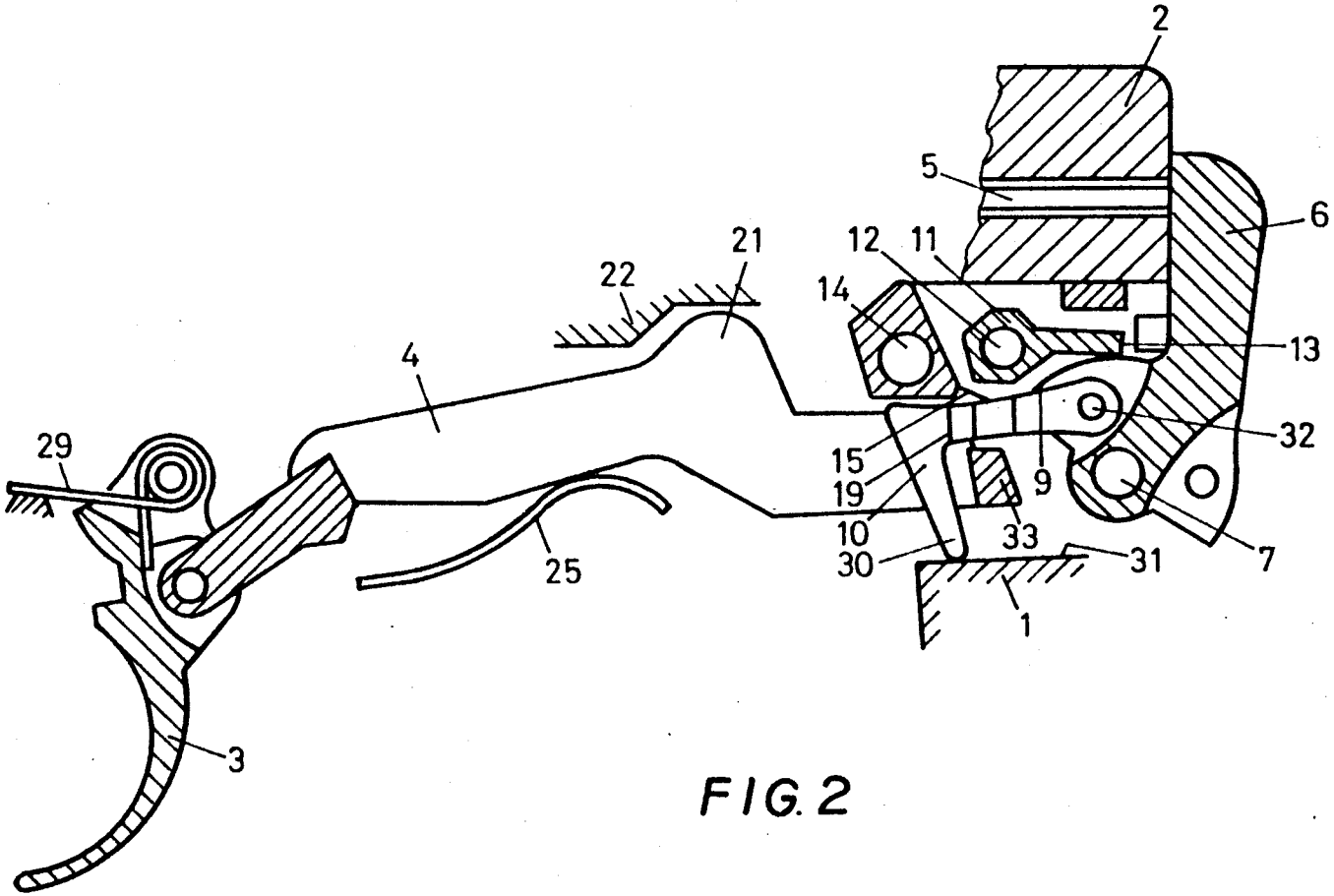
FIG. 2 is a sectional view of operating parts, illustrating the hammer in its firing position.

FIG. 2 illustrates the above explained parts on a somewhat enlarged scale and a somewhat more detailed basis. The trigger 3 is biased by means of a spiral 29, in a manner generally known, into its rest position. The hammer 6 is pivotally mounted to the frame 1 at the pivot axis 7. An interrupter 10 is pivotally mounted to the hammer 6. This interrupter 10 includes a projection 30, projecting downwards as illustrated in FIG. 2. This projection 30 is to cooperate with an incline 31 formed at the frame 1, which incline 31 extends obliquely in such a manner that when the trigger bar 4 is displaced, based on the illustration of FIG. 2, towards the right side, ie towards the hammer 6, the projection 30 of the interrupter 10 will come to contact the incline 31 such that upon a continued movement towards the right the interrupter 10 is pivoted upwards.

The hammer 6 includes a resting surface 9, also termed searing surface. This resting surface 9 is adapted to cooperate with a blocking surface 13 of the sear 11, which is rotatable around a pivot axis 12, whereby in the sectional view of FIG. 2 a projection 20 of the sear 11, which will be described more in detail later on, is not visible. FIG. 2 illustrates further the ejector 14, which includes a further incline 15 that is adapted to cooperate with an incline 18 formed at the trigger bar 4 (illustrated in FIG. 5). The hammer 6 as illustrated in FIG. 2 is in its firing position, whereto it is specifically to be noted that the blocking surface 13 of the sear 11 does not contact the resting surface 9 of the hammer 6, and that there is no operational contact between the interrupter 10 and the trigger bar 4.

Figure 3:
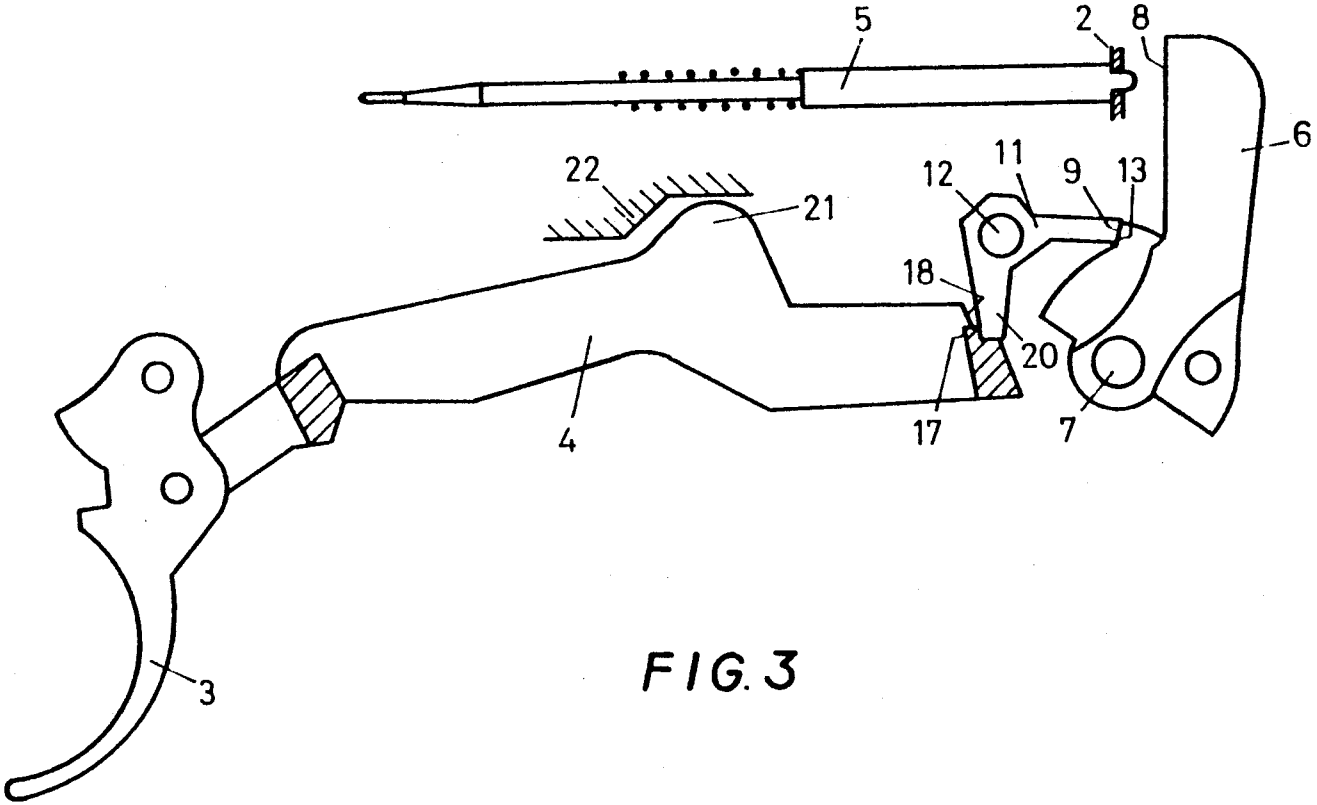
FIG. 3 is a sectional view of operating parts, illustrating the hammer in its decocked position.

Attention is now drawn to FIG. 3, in which the hammer 6 is illustrated in its decocked position. FIG. 3 is intended specifically for a detailed explanation of the operation of the sear 11. The sear 11 is mounted in the frame 1 to pivot around the axis 12. The projection 20 of the sear 11, which projects downwards in the illustration of FIG. 3, is located in a recess 17 of the trigger bar 4, which recess 17 is termed for the sake of illustration in this description as second recess 17. The blocking surface 13 of the sear 11 contacts the resting surface 9 of the hammer 6, such that the striking surface 8 of the hammer 6 in its decocked state, as illustrated in FIG. 3, is located at a distance from the rear end of the firing pin 5, which rear end projects according to known designs through an end plate of the slide 2.

Figure 4:
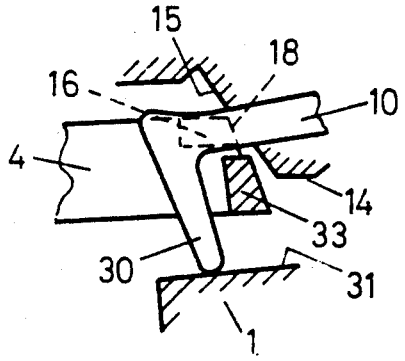
FIG. 4 is a view illustrating a detail of the interrupter and parts of the pistol cooperating with same.
Figure 5:
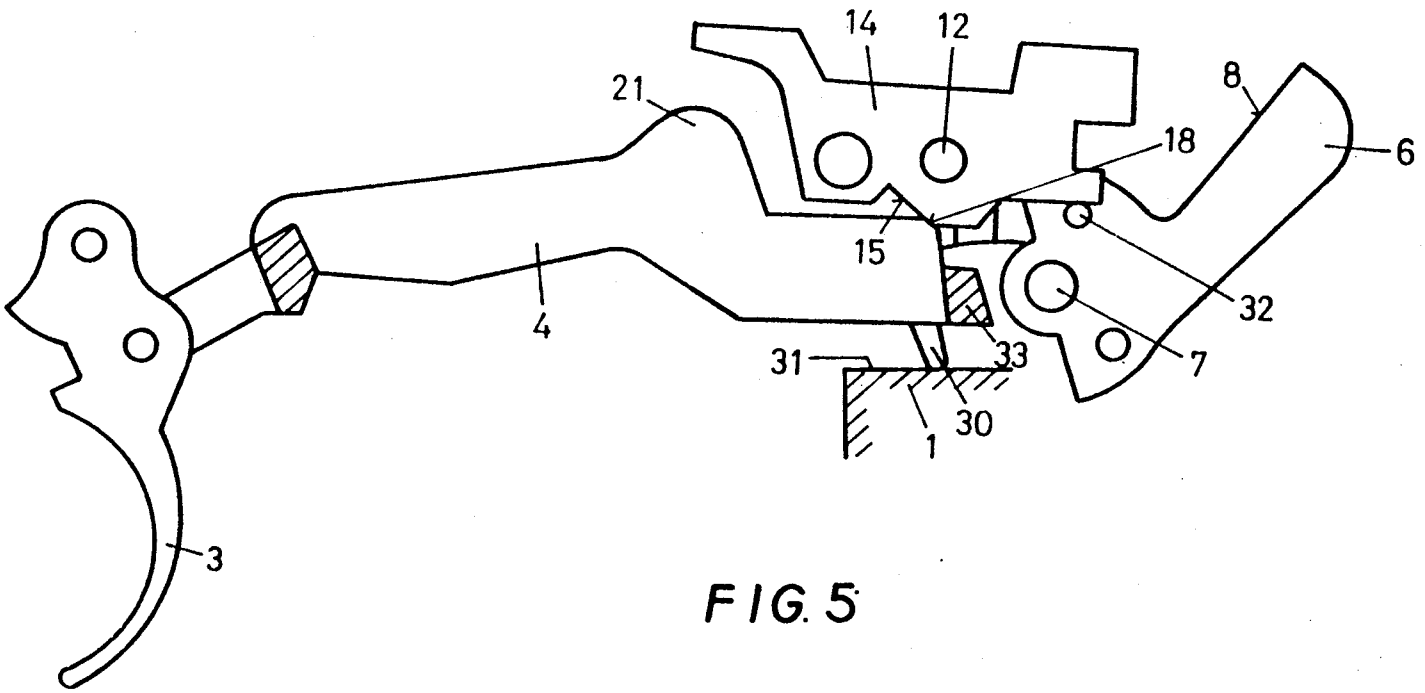
FIG. 5 is a sectional view of operating parts, in which the hammer is illustrated in its cocked position.
Figure 6:
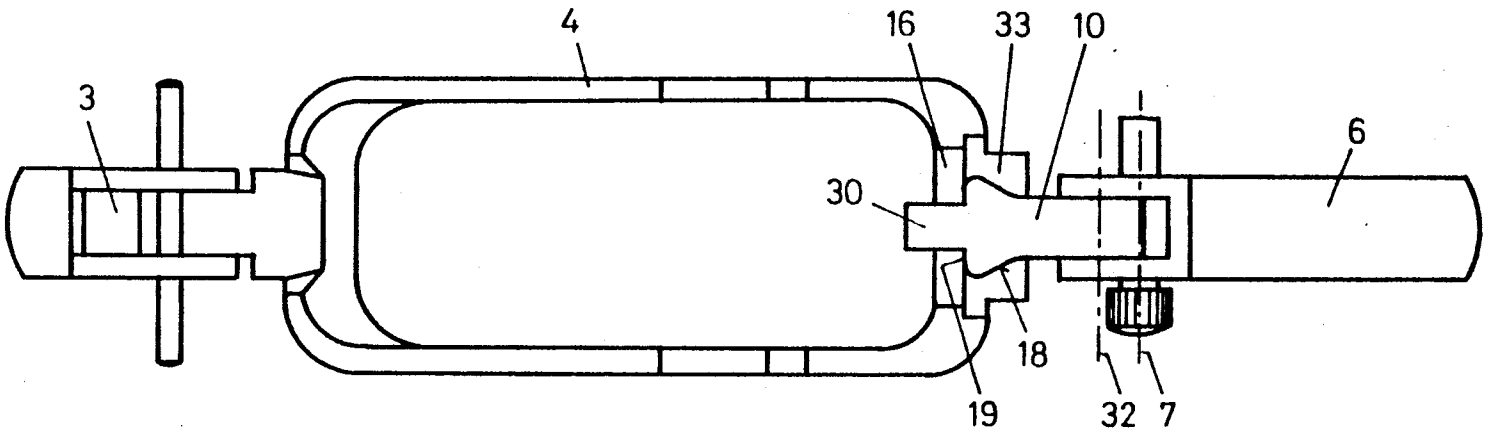
FIG. 6 is a top view specifically of the trigger bar, the interrupter and the hammer.

Attention is now drawn specifically to FIGS. 4 and 6, based on which the interrupter 10 will be described. The interrupter 10 is pivotally mounted to the hammer 6 at a pivot axis 32, which hammer 6 is in turn pivotally mounted to the frame 1 to pivot around the pivot axis 7. The interrupter 10 extending over the rear cross member 33 of the trigger bar 4 includes a projection 30 projecting downwards. This projection 30 is to cooperate with an incline 31 formed at the frame 1. The interrupter 10 includes, furthermore, a shoulder 19 which cooperates with a first recess 16 formed at the trigger bar 4. FIGS. 4 and 5 illustrate, furthermore, the incline 15 of the ejector 14, which is adapted to cooperate with the incline 18 of the trigger bar 4. Thus, when the trigger bar 4 is moved, based on the illustrations, towards the right, the interrupter 10 is also moved towards the right, because the first recess 16 at the trigger bar 4 abuts the shoulder 19 of the interrupter 10. Towards the end of this movement towards the right, the interrupter 10 begins to pivot upwards because its projection 20 resting on the incline 31 is urged upwards. At the same time the incline 18 of the trigger bar 4 contacts the incline 15 of the ejector 14, such that simultaneously the rear end of the trigger bar 4 is pivoted downwards, wherewith now the shoulder 19 of the interrupter 10 lifts off and outwards from the first recess 16 of the trigger bar 4, such that the connection between the interrupter 10 and the trigger 4 is interrupted, which in turn allows the interrupter 10 and accordingly the hammer 6 to snap towards the left under the biasing action of the hammer rod spring 28, such that the hammer can strike the firing pin 5. Conversely, when the hammer 6 is cocked, that is when the hammer 6 is pivoted clockwise based on the illustration of the figures, the projection 30 of the interrupter 10, which contacts the cross member 33 of the trigger bar 4, pulls the trigger bar 4 towards the right side.

The operation of the structural parts of the firearm described above is as follows. In order to chamber a cartridge out of the loaded magazine (not shown), the slide 2 is manually pulled backward, whereby it contacts the hammer 6, which hammer 6 is pivoted backwards around the pivot axis 7 relative to the frame 1. The hammer rod spring 28 is pressed together, ie biased, because the hammer rod 27 is moved downward due to the pivoting movement of the hammer 6. During the pivoting movement of the hammer 6, the interrupter 10, which is pivoted to the hammer 6, is pulled backward, The interrupter 10 contacts as described above via its projection 30 the cross member 33 of the trigger bar 4, such that the trigger bar 4 is also pulled backward, causing in turn the trigger 3 linked thereto to pivot backward.

After the slide 2 has reached its rearmost position it is released and moves again forward into its rest position and during this movement a cartridge 24 is chambered from the (not illustrated) magazine into the (not illustrated) chamber. During the forward movement of the slide 2, the hammer is decocked and moves again forward, ie into the position illustrated in FIG. 3. This pivoting movement of the hammer 6 is obviously initiated by the hammer spring 28. The reason now that the hammer 6 remains in the position illustrated in FIG. 3 is that it contacts at its resting surface 9 the blocking surface 13 of the sear 11, which sear 11 is spring-biased in the clockwise direction according to known principles. It is now obvious that the firing pin 5 is not contacted by the hammer 6, specifically its striking surface 8, such that the hammer 6 cannot contact the firing pin 5 eg when the gun is dropped, because it is blocked by the sear 11 in the mentioned position.

For firing the gun the trigger 3 is pulled and accordingly the trigger bar 4 moves backward. The trigger bar 4 thereby contacts the interrupter 10, ie the first recess 16 of the trigger bar 4 comes to rest against the shoulder 19 of the interrupter 10, such that the interrupter 10 is also moved backward and moves in turn the hammer 6, which rotates clockwise around the pivot axis 7, such to rotate towards its cocked position. Shortly prior to reaching the end of its path of movement, the trigger bar 4 contacts at its second recess 17 the projection 20 of the sear 11, such that the sear 11 is rotated around the axis of rotation 12 in a counter-clockwise direction. Accordingly, the blocking surface 13 of the sear 11 is moved away from the resting surface 9 of the hammer.

Such as has already been mentioned above, the interrupter 10 pivots during the backward movement of the trigger bar 4 upwards, and the rear end of the trigger bar 4 pivots simultaneously downwards, and accordingly the interrupter 10 loses its contact with the trigger bar 4 such that now the hammer 6 can snap forward due to the force exerted thereupon by the hammer spring 28. Now the interrupter 10 is moved forward relative to the trigger bar 4, which in this instance is at rest, because the shoulder 19 of the interrupter 10 is located remote from the trigger bar 4. At the end of its forward directed pivoting movement, the hammer 6 strikes onto the firing pin 5, which in turn strikes onto the chambered cartridge 24, such that the cartridge is fired.

Due to the pressure generated by the explosion in the cartridge, the slide 2 is moved backward it recoils towards the hammer 6, and cocks the hammer 6, moves thereafter due to the (not illustrated) return spring again forward, such to chamber a further cartridge into the chamber and to release the hammer 6 in such a manner that the hammer 6 can again pivot back into the position illustrated in FIG. 3, in which position it is blocked by the sear 11. This blocking is possible because the slide 2 acts during its recoil movement by means of its incline 22 onto the projection 21 of the trigger bar 4, such that the trigger bar 4 is once more pivoted downwards for a short-time span in order to allow a reversed movement of the (spring-loaded) sear 11 into the position illustrated in the figure. Accordingly, the hammer 6 is again in its decocked and safe position. Although the herein disclosed embodiment has been described in connection with a pistol, which is designed as double action piston, it is also possible to embody the invention in revolvers.

While there is shown and described the present preferred embodiment of the invention, it is to be distinctly understood that the invention is not limited thereto, but may be otherwise variously embodied and practised within the scope of the following claims.

I claim:

1. A firearm, comprising:

a frame;

a slide mounted on the frame for sliding longitudinal movement thereupon;

a trigger pivotally mounted to the frame for movement between a rest position and a firing position;

a trigger bar pivotally mounted to the trigger for moving therewith between a rest position and a firing position;

a firing pin having a front and a rear end and mounted in the slide for travel between a rest position and a firing position;

a hammer pivotally mounted to the frame for a pivoting movement around a pivot axis between a decocked and a cocked position, the hammer including a striking surface for striking the rear end of the firing pin and a resting surface;

an interrupter pivotally mounted to the hammer;

a spring loaded sear rotatably mounted to the frame for a rotational movement around an axis of rotation between a hammer blocking position and a hammer release position, the sear including a hammer blocking surface for contacting the resting surface of the hammer when the hammer is in its decocked position, the hammer blocking surface being at a rotational position remote from the resting surface of the hammer when the sear is in its hammer release position; and an ejector for spent cartridge shells, the ejector including an incline, in which the location of the blocking surface of the sear relative to its axis of rotation, the location of the resting surface of the hammer relative to its pivot axis, and the location of the rear end of the firing pin in its rest position are selected in such a manner that, when the hammer is in its decocked position, the blocking surface of the sear contacts the resting surface of the hammer and the striking surface of the hammer is located at a distance from the rear end of the firing pin;

in which the trigger bar comprises a first recess, a second recess and an incline located at a distance from the incline of the ejector;

and in which the interrupter comprises a shoulder which projects into the first recess of the trigger bar;

whereby upon a movement of the trigger bar from the rest position towards the firing position the interrupter is taken along by the trigger bar to cause a cocking of the hammer and upon a continued movement of the trigger bar towards the firing position the incline of the trigger bar comes to glide along the incline of the ejector such to cause a pivoting movement of the trigger bar with its first recess away from the interrupter and its shoulder, such that the shoulder leaves the first recess and allows a snapping of the hammer against the firing pin for a firing of the firearm.

2. The firearm of claim 1, in which the sear comprises a projection which projects into the second recess of the trigger bar in such a manner that upon a movement of the trigger bar from its rest position towards its firing position a rotating of the spring loaded sear from its hammer blocking position into its hammer release position is brought about, and in which the trigger bar comprises a projection and the slide comprises a control incline adapted to act onto the projection when the slide is moved towards the hammer in order to cause the trigger bar to pivot with its second recess away from the sear and its projection in such a manner that the projection is released from the second recess in order to allow the spring loaded sear to snap back into its hammer blocking position.

* * * * *